US008297371B1

(12) United States Patent
Musser, Jr.

(10) Patent No.: US 8,297,371 B1
(45) Date of Patent: Oct. 30, 2012

(54) SYSTEM AND METHODS FOR FIRE PROTECTION

(76) Inventor: John E. Musser, Jr., Sunrise, FL (US)

( * ) Notice: Subject to any disclaimer, the term of this patent is extended or adjusted under 35 U.S.C. 154(b) by 376 days.

(21) Appl. No.: 12/692,620

(22) Filed: Jan. 24, 2010

Related U.S. Application Data

(63) Continuation-in-part of application No. 12/150,585, filed on Apr. 29, 2008, now abandoned.

(51) Int. Cl.
*A62C 8/00* (2006.01)
*A62C 3/06* (2006.01)
*A62C 2/00* (2006.01)

(52) U.S. Cl. ..... 169/48; 169/67; 169/43

(58) Field of Classification Search ..... 169/48, 169/49, 67
See application file for complete search history.

(56) References Cited

U.S. PATENT DOCUMENTS 3,715,843 A * 2/1973 Ballinger ..... 52/3
3,815,682 A * 6/1974 Chiasson et al. ..... 169/49
5,146,996 A * 9/1992 Gainer, Jr. ..... 169/49
6,474,420 B1 11/2002 Adiga
6,725,941 B2 4/2004 Edwards et al.
6,810,626 B2 * 11/2004 Meyer et al. ..... 52/1
7,087,105 B1 8/2006 Chappell et al.
7,128,207 B2 * 10/2006 Anderson et al. ..... 206/223

* cited by examiner

*Primary Examiner* — Len Tran
*Assistant Examiner* — Justin Jonaitis

(57) ABSTRACT

A fire protection system for helping to prevent an area from catching fire comprising a large fire-resistant tarp for draping over the area; cables slidably attached along the side edges of the tarp via eyelets; a guide rope near the bottom of the tarp for helping to help spread the tarp over the area; a plurality of attachment components at the bottom of the tarp for attaching to a structure in the area to secure the tarp; a weighted component disposed near the bottom edge of the tarp to help guide the tarp to a particular position over the area or help prevent the tarp from being blown by drafts; and a flap disposed at the bottom edge of the tarp, the flap remains unrestrained when the tarp is secured over the area, wherein an individual can take shelter beneath the flap.

8 Claims, 7 Drawing Sheets

SYSTEM AND METHODS FOR FIRE PROTECTION

The present application is a continuation-in-part of U.S. patent application Ser. No. 12/150,585 filed Apr. 29, 2008, the disclosure of which is incorporated in its entirety by reference herein.

FIELD OF THE INVENTION

The present invention is directed to a system and methods for protecting and area and preventing the spreading of fires. More particularly, the present invention is directed to a system involving draping a large tarp over an area/structure to protect the area/structure by helping to prevent the area/structure from catching fire.

BACKGROUND OF THE INVENTION

Fire fighting methods generally involve dousing a fire with water or using a non-flammable chemical to smother flames. The present invention features a fire protection system comprising a large tarp for draping over an area in danger of catching fire. The present invention also features methods of protecting an area from spreading fire.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
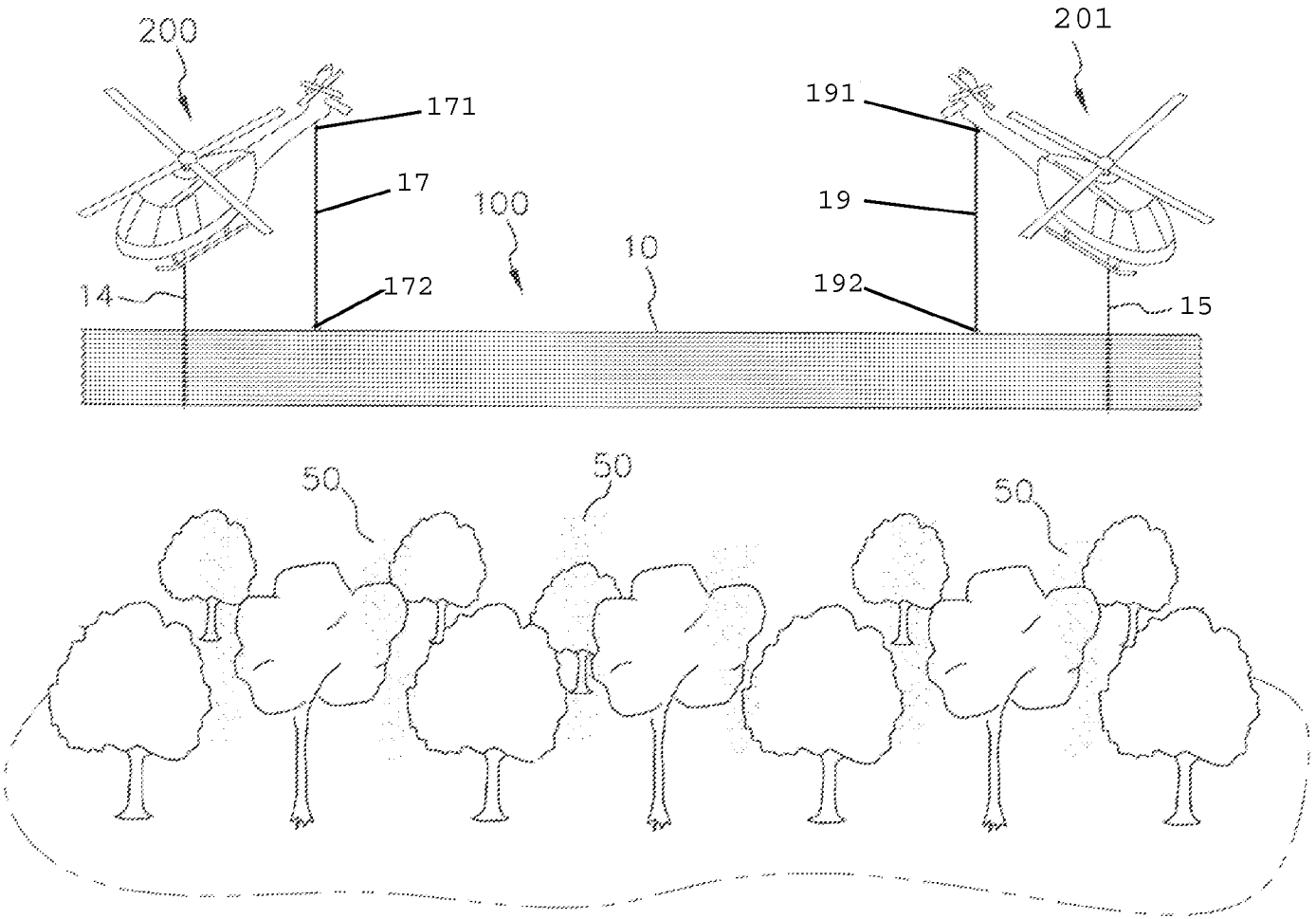
FIG. 1 is a perspective view of the fire protection system of the present invention wherein the tarp is folded into accordion-style folds.

Referring now to FIGS. 1-5, the present invention features a fire protection system 100 for helping to protect an area from catching fire. The fire protection system of the present invention may also help prevent the spreading of fire 55.

The fire protection system 100 of the present invention comprises a large fire-resistant tarp 10 for draping over the area that may be in danger of catching fire. The area may include but is not limited to a home 75, a building, a structure, a forest 50, and/or an area with vegetation. Generally, the fire protection system 100 employs a lifting means (e.g., an aircraft such a helicopter 200, a crane 250) to drape the system 100 over the area.

The tarp 10 may be constructed from a heavy fabric. In some embodiments, the tarp 10 is impregnated with a fire retardant substance. In some embodiments, the tarp 10 is constructed from a ceramic fabric (some are presently priced at $7.87). In some embodiments, the tarp can withstand a temperature of 2,800 degrees F. The tarp 10 has a first side edge, a second side edge, a top edge, and a bottom edge. The tarp 10 can be in an extended position or a folded position. In the folded position, the tarp 10 is folded in accordion-style folds (see FIG. 2). The tarp comprises horizontal pleats 20 that allows the tarp to be collapsed and expanded vertically in an accordion style, wherein a panel 21 is disposed between two adjacent folds 22 and 23, and a plurality of pleats are horizontally disposed on the tarp. Each panel 21 has one eyelet for the first cable 14 and one eyelet for second cable 15 to slidably insert through. The first cable 14 has an upper end 141 and a lower end 142, the second cable 15 has an upper end 151 and a lower end 152, wherein the upper end of the first cable attaches to the first helicopter 200 and the upper end of the second cable attaches to the second helicopter 201. A third cable 17 is attached to the top panel 110 of the tarp and a fourth cable 19 attached to the top panel 110 of the tarp, wherein the third cable has an upper end 171 and a lower end 172, the fourth cable has an upper end 191 and a lower end 192, wherein the upper end 171 of the third cable 17 attaches to the first helicopter 200 and the upper end 191 of the fourth cable 19 attaches to the second helicopter 201, wherein the lower end 172 of the third cable 17 attaches to top panel of the tarp 10 and the lower end 192 of the fourth cable 19 attaches to the top panel of the tarp 10. In some embodiments, the tarp is about 1,000 feet long, about 800 feet wide, and about 0.5 inch thick. In some embodiments, the tarp is about 90,000 pounds.

Cables 14 may be attached along the first side edge and second side edge of the tarp 10. In some embodiments, the cables 14 are disposed in a plurality of eyelets disposed in the tarp 10. The eyelets are along the folding direction of tarp. This allows cables 14 to move independently of the tarp 10. In some embodiments, the cables 14 and/or guide ropes 90 may help guide the tarp 10 as it is lowered (and unfolded). Guide ropes 90 may be disposed at or near the bottom edge of the tarp 10. In some embodiments, guide ropes 90 are disposed at or near the top edge of the tarp 10. The guide ropes 90 at the top edge of the tarp 10 may be used when the top end of the tarp 10 is to be lowered over the area.

In some embodiments, one or more attachment components 16, 18 are disposed at or near the bottom edge of the tarp 10. In some embodiments, attachment components 16, 18 are disposed at or near the top edge of the tarp 10. The attachment components 16, 18 (e.g., ties, ropes, etc.) may be used by ground personnel to secure the tarp 10 to nearby structures such as trees or portions of a home or building. The attachment components 16, 18 may also help the tarp 10 be fully stretched out and/or secured over the area.

In some embodiments, a weighted component 80 is disposed at or near the bottom edge of the tarp 10. In some embodiments, the weighted component 80 is constructed from a material comprising sand (e.g., a sandbag). The weighted components 80 may be disposed (e.g., sewn on, clipped to, etc.) on the tarp 10 at or near the bottom edge. Weighted components 80 may be disposed at or near the top edge. The weighted component 80 helps the tarp 10 to fully deploy and be guided toward target area in a particular orientation. The weighted component 80 may also help prevent the tarp 10 from being blown by drafts such as updrafts caused by a fire.

Figure 2A:
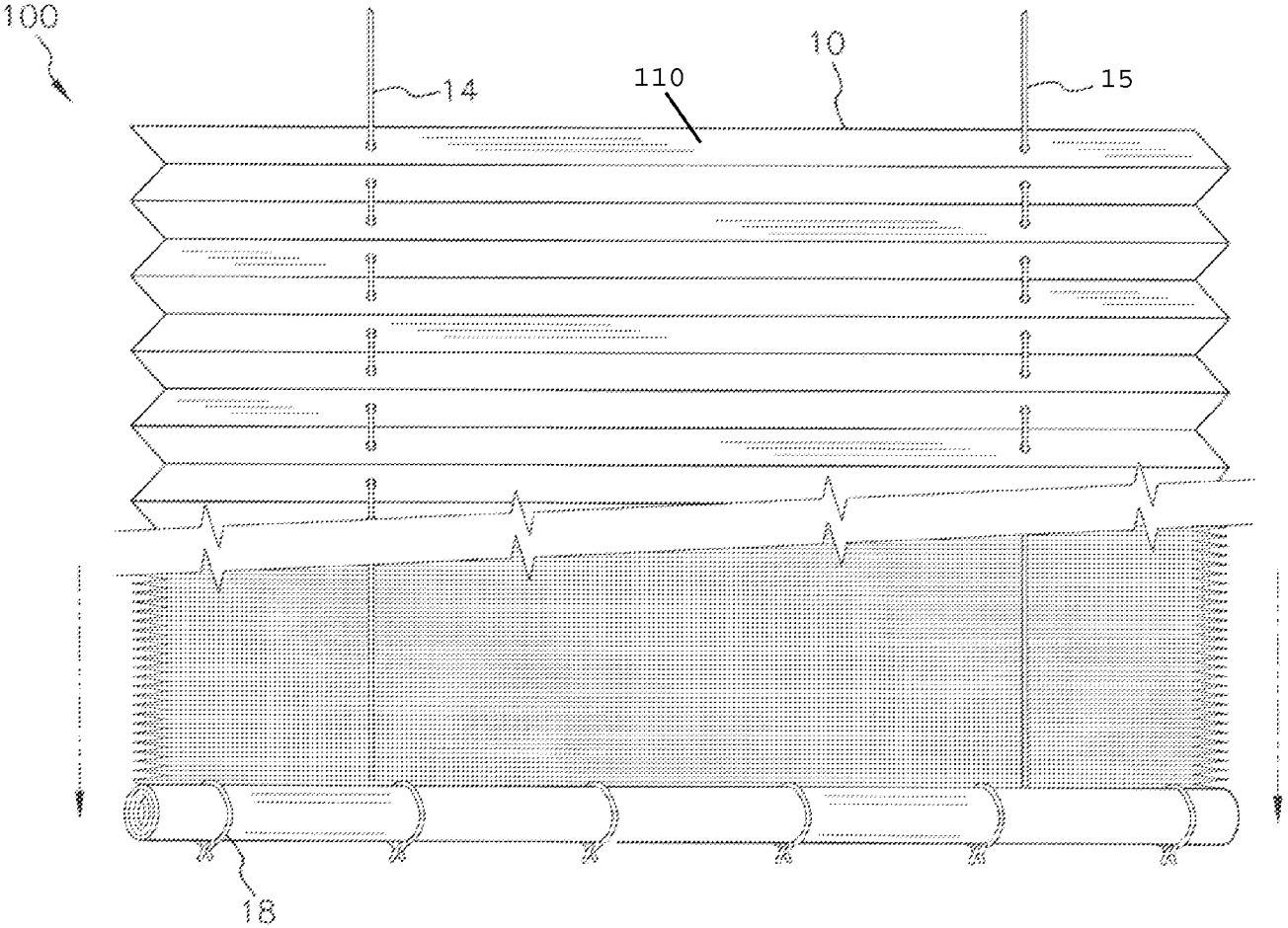
FIG. 2A is a front view of the tarp of the system of the present invention.
Figure 2B:
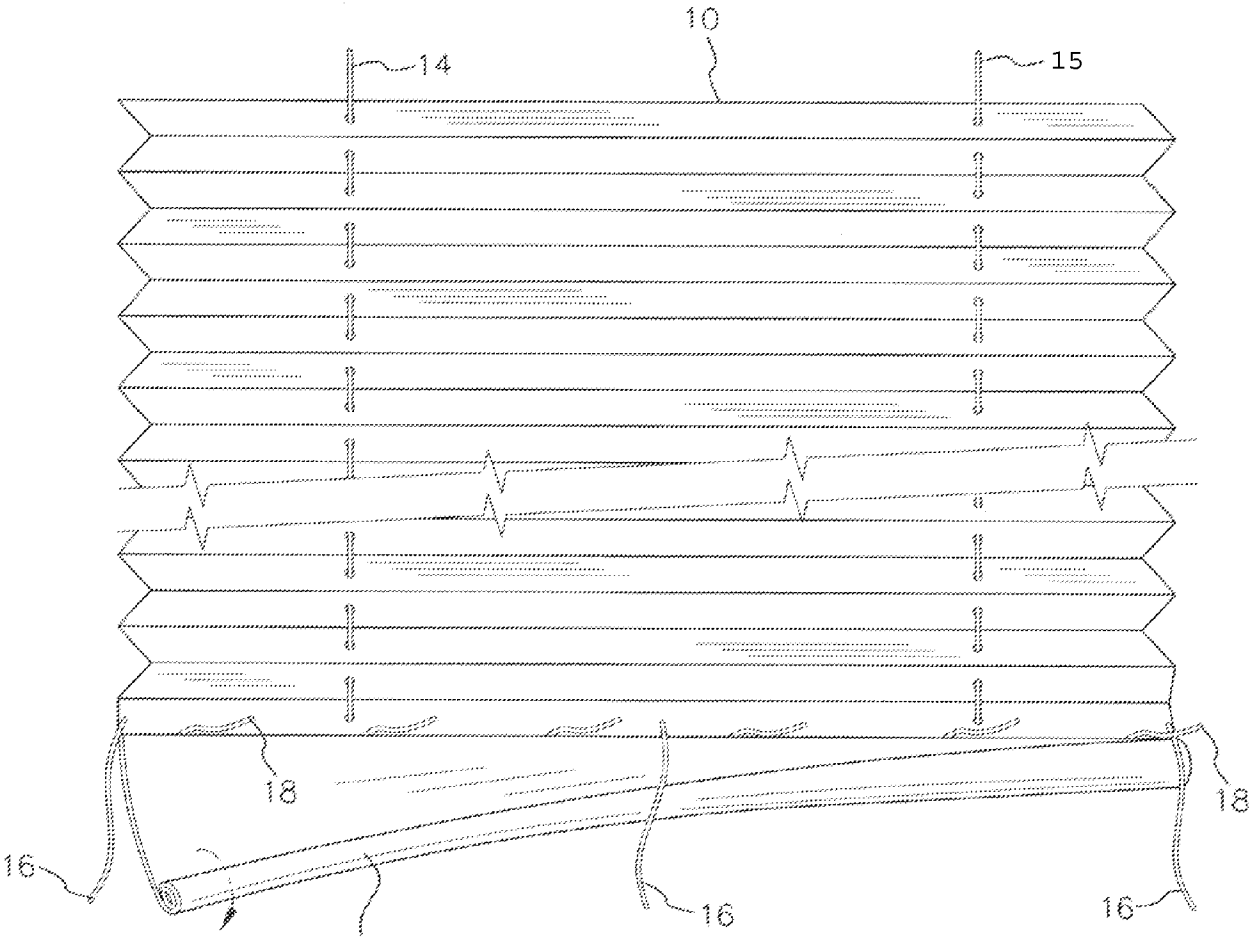
FIG. 2B is a front view of the tarp of the system of the present invention wherein the rolled portion of the tarp is partially unrolled.
Figure 3:
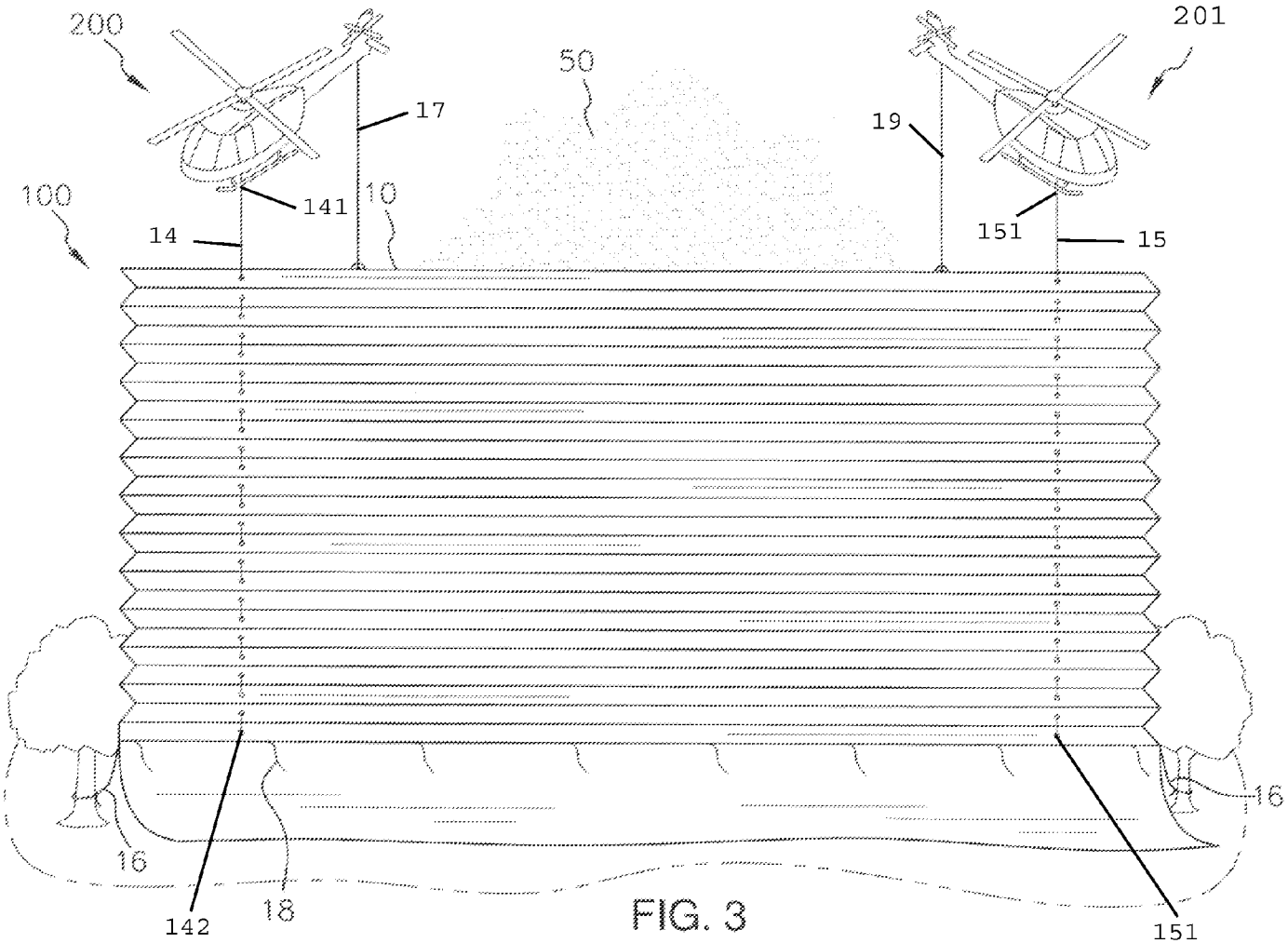
FIG. 3 is a perspective view of the fire protection system of the present invention wherein helicopters have lowered the tarp to an area so as to drape the tarp over the area.
Figure 4:
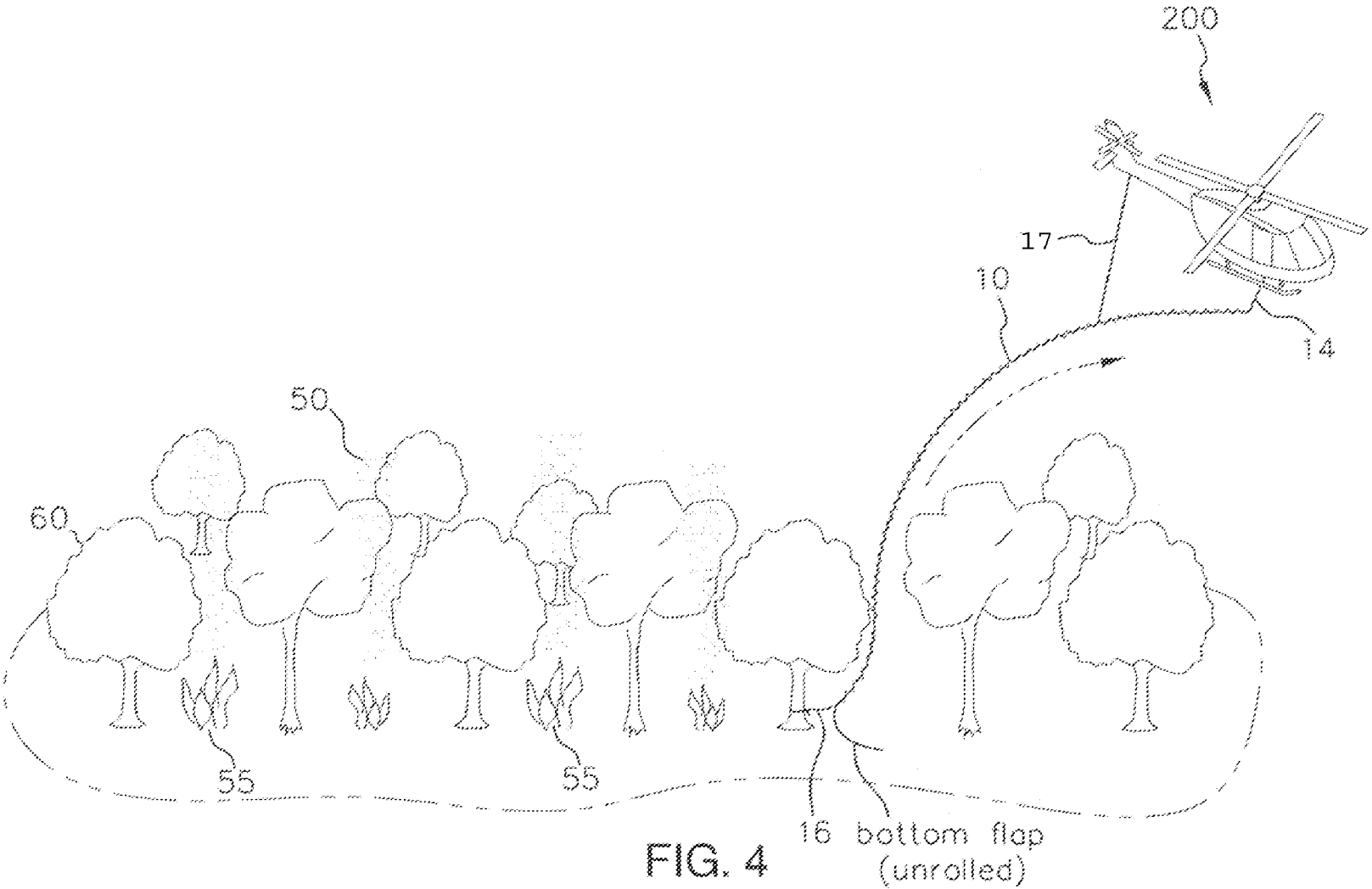
FIG. 4 is a side view of the system of the present invention wherein the tarp is draped over an area.
Figure 5A:
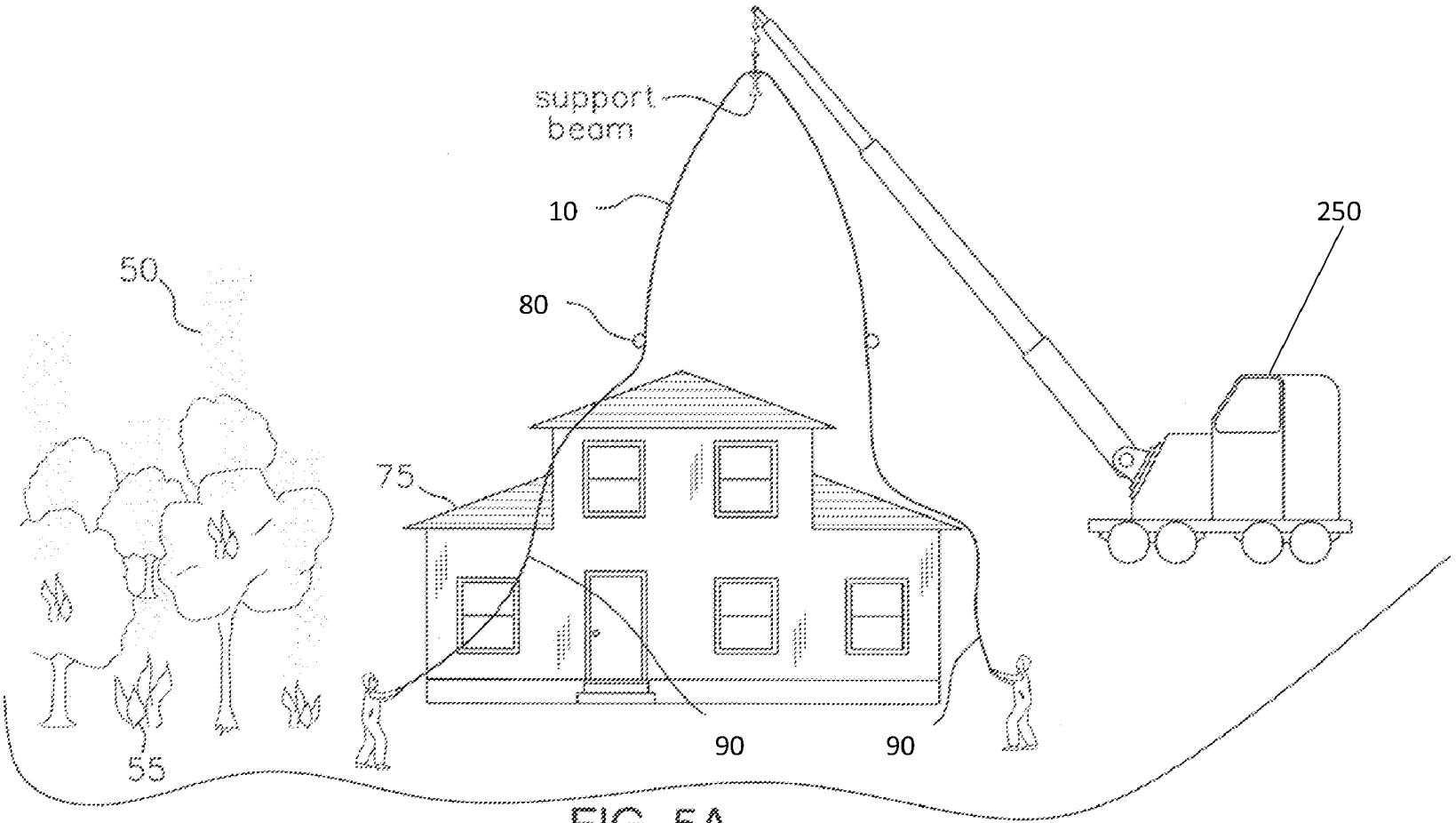
FIG. 5A is a side view of the system of the present invention wherein a crane is used to drape the tarp over a home.
Figure 5B:
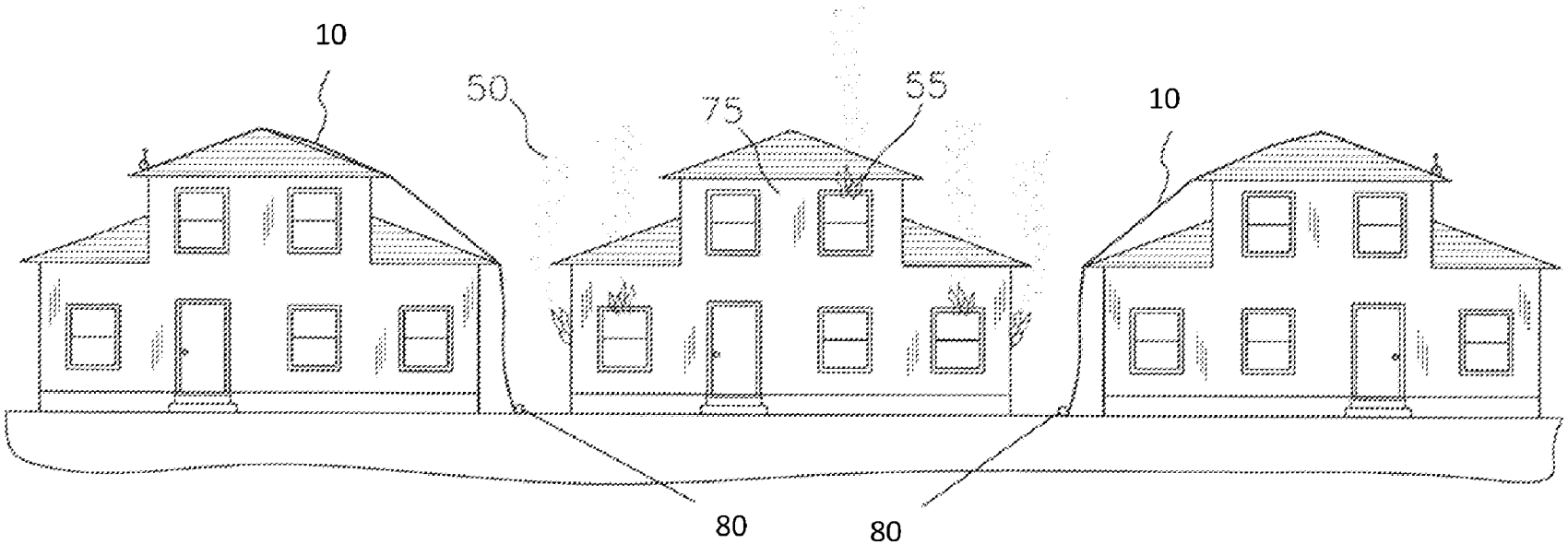
FIG. 5B is a side view of the system of the present invention wherein two houses are covered with tarps so as to prevent the fire from spreading to those houses.

As shown in FIG. 2B, in some embodiments, a flap is disposed at the bottom edge of the tarp 100. The flap may be rolled up for storage purposes. When the tarp 10 is lowered to the ground, the flap may be unrolled. In some embodiments, the flap is used as a safety feature. For example, if ground personnel are trapped as a fire 55 approaches, he/she can take shelter beneath the flap. Generally, even when the attachment components are secured to structures, the flap is still unrestrained.

The present invention also features a method of protecting an area from fire using the fire-resistant tarp 10 of the present invention. The method comprises using a lifting means (e.g., helicopters 200, crane) to draping the tarp 10 over the area. In some embodiments, the method further comprises securing the attachment means to nearby structures so as to secure the tarp 10 over the area.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fire protection system for helping to prevent an area from catching fire, said system comprising:

(a) a first helicopter and a second helicopter;

(b) a large fire-resistant tarp for draping over the area, the tarp protects the area from fire, wherein the tarp comprises horizontal pleats that allows the tarp to be collapsed and expanded vertically in an accordion style, wherein a panel is disposed between two adjacent folds, and a plurality of pleats are horizontally disposed on the tarp;

(c) a first cable attached along a first side edge of the tarp and a second cable attached along a second side edge of the tarp, wherein the cables are slidably attached to the tarp via eyelets disposed along folding direction in the tarp, wherein each panel has one eyelet for the first cable to slidably insert through, wherein each panel has one eyelet for the second cable to slidably insert through, the first cable has an upper end and a lower end, the second cable has an upper end and a lower end, wherein the upper end of the first cable attaches to the first helicopter and the upper end of the second cable attaches to the second helicopter;

(d) a third cable attached along the top panel of the tarp and a fourth cable attached the top panel of the tarp, wherein the third cable has an upper end and a lower end, the fourth cable has an upper end and a lower end, wherein the upper end of the third cable attaches to the first helicopter and the upper end of the fourth cable attaches to the second helicopter, wherein the lower end of the third cable attaches to top panel of the tarp and the upper end of the fourth cable attaches to the top panel of the tarp;

(e) a guide rope disposed near a bottom edge of the tarp, wherein an individual can use the guide rope to help spread the tarp over the area;

(f) a plurality of attachment components disposed at the bottom edge of the tarp, wherein an individual can attach the attachment components to a structure in the area to secure the tarp;

(g) a weighted component disposed near the bottom edge of the tarp to help guide the tarp to a particular position over the area or help prevent the tarp from being blown by drafts; and (h) a flap disposed at the bottom edge of the tarp, the flap remains unrestrained when the tarp is secured over the area, wherein an individual can take shelter beneath the flap.

2. The system of claim 1 wherein the tarp is impregnated with a fire-retardant substance.

3. The system of claim 1, wherein the attachment components are ties or ropes.

4. The system of claim 1, wherein the weighted component is constructed from a material comprising sand.

5. The system of claim 1 further comprising a weighted component disposed near a top edge of the tarp.

6. The system of claim 1, wherein the flap is rolled up for storage purposes.

7. A method of preventing an area from catching fire, said method comprising:

(a) obtaining a fire protection system comprising:

(i) a large fire-resistant tarp for draping over the area, the tarp protects the area from fire, wherein the tarp can be in a folded position wherein the tarp is folded in accordion-style folds and an extended position wherein the tarp is stretched;

(ii) a first cable attached along a first side edge of the tarp and a second cable attached along a second side edge of the tarp, wherein the cables are slidably attached to the tarp via eyelets disposed along folding direction in the tarp;

(iii) a third cable attached the top panel of the tarp and a fourth cable attached along the top panel of the tarp, wherein the third cable has an upper end and a lower end, the fourth cable has an upper end and a lower end, wherein the upper end of the third cable attaches to the first lifting means and the upper end of the fourth cable attaches to the second lift means, wherein the lower end of the third cable attaches to top panel of the tarp and the upper end of the fourth cable attaches to the top panel of the tarp;

(iv) a guide rope disposed near a bottom edge of the tarp, wherein an individual can use the guide rope to help spread the tarp over the area;

(v) a plurality of attachment components disposed at the bottom edge of the tarp, wherein an individual can attach the attachment components to a structure in the area to secure the tarp;

(vi) weighted component disposed near the bottom edge of the tarp to help guide the tarp to a particular position over the area or help prevent the tarp from being blown by drafts; and (vii) a flap disposed at the bottom edge of the tarp, the flap remains unrestrained when the tarp is secured over the area, wherein an individual can take shelter beneath the flap;

(b) employing a lifting means to drape the fire protection system over the area;

(c) attaching the attachment components to structures in the area to secure the tarp in place.

8. The method of claim 7, wherein the lifting means includes an aircraft, a helicopter, and a crane.

* * * * *